United States Patent [19]

Sievers

[11] 4,180,288

[45] Dec. 25, 1979

[54] GOLF BALL RETRIEVER

[76] Inventor: Paul T. Sievers, 986 Fenworth Blvd., Franklin Square, N.Y. 11010

[21] Appl. No.: 879,394

[22] Filed: Feb. 21, 1978

[51] Int. Cl.[2] ..... B66F 11/00

[52] U.S. Cl. ..... 294/19 A

[58] Field of Search ..... 294/19 A, 19 R, 33, 294/99 R, 55.3; 273/320, 32 R, 162 R, 33, 162 C, 162 E, 162 F

[56] References Cited

U.S. PATENT DOCUMENTS

| | | | |
|---|---|---|---|
| 3,520,569 | 7/1970 | Anderson | 294/19 A |
| 3,547,477 | 12/1970 | Young | 294/19 A |

FOREIGN PATENT DOCUMENTS

| | | | |
|---|---|---|---|
| 270206 | 5/1966 | Australia | 294/19 A |

*Primary Examiner*—James B. Marbert

*Attorney, Agent, or Firm*—Eyre, Mann, Lucas & Just

[57] ABSTRACT

A golf ball retriever has a retriever element at the end of a shaft. The retriever element consists of a loop with a spring-wire spiral wrapped about the loop. The spring-wire spiral defines an inner diameter smaller than the diameter of a golf ball whereas the loop defines an inner diameter larger than the diameter of a golf ball. A golf ball may be made to pass through the inner diameter of the spring-wire spiral by deflecting the spiral outward momentarily. A retaining finger is disposed on one side of the loop to positively secure a golf ball in the retained position.

7 Claims, 5 Drawing Figures

GOLF BALL RETRIEVER

BACKGROUND OF THE INVENTION

A serious expense item for golfers is the cost of replacement of lost balls. Frequently, balls must be considered lost whose position is well-known but which are unavailable to the golfer because of obstructions in his path. For example, a ball hit into a water hazard, even if in plain sight, is effectively lost unless the golfer is willing to get wet in order to retrieve the ball. In other common situations, a ball comes to rest on the other side of an unscaleable fence bordering a golf course. Very frequently, the ball rests just a few feet on the other side of the fence but must be considered lost for lack of a means to retrieve it.

Retrievers are known in the art which provide a scoop type device for lifting, supporting and retrieving a golf ball in a cup-shaped member. Such a device is shown in U.S. Pat. No. 3,520,569. Another retriever device employing an elongated wire loop member is shown in U.S. Pat. No. 2,448,644 and British Pat. No. 2791. These devices capture a ball between wire bars and retain it therein. A retrieving device employing a wire loop is shown in U.S. Pat. No. 3,520,569. This patent supports a ball on the loop with no provision for keeping it from falling off while the ball is being retrieved from a distance. Gripping retrievers are disclosed in U.S. Pat. No. 3,922,027. A rake-type retriever is disclosed in U.S. Pat. No. 2,738,214. A fork-type retriever is disclosed in U.S. Pat. No. 3,434,753.

SUMMARY OF THE INVENTION

The present invention teaches a retriever which is placed over the diameter of a golf ball employing very little force and which then positively retains the golf ball in a captured position until it is retrieved. A generally circular loop of substantially rigid material is attached at the end of a shaft. An extension of the axis of the shaft is approximately parallel to the plane of the loop. A resilient spiral is wrapped around the loop. The diameter of the spiral is substantially greater than the size of the material forming the loop. Therefore, the spiral is free to move radially with respect to the loop. The spiral is tensioned in the circumferential direction thereby causing the spiral to bear against the outside perimeter of the loop. The inner perimeter of the spiral is, therefore, moved inward and reduces the effective opening of the loop. The dimensions of the loop and spiral are arranged so that a golf ball may pass through the opening by pressing aside the spiral with a relatively light force being applied. A retaining finger engages the surface of a golf ball which has been passed part way through the loop and holds it firmly engaged in the retriever during the retrieving process. Once the loop of the retriever is brought to hand, the golf ball is readily dislodged by forcing it through the loop in the opposite direction.

DETAILED DESCRIPTION OF THE PREFERRED EMBODIMENT

Figure 1:
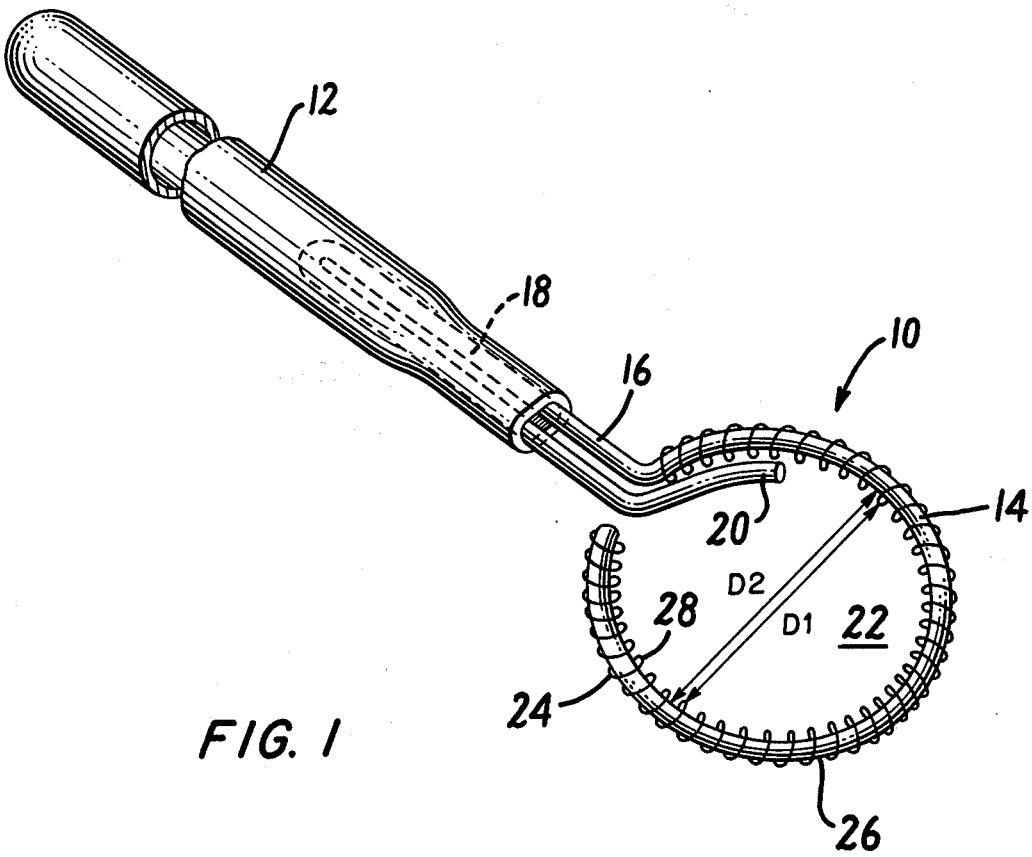
FIG. 1 shows a perspective view of a golf ball retriever according to the present invention.

Referring to FIG. 1, a retriever head shown generally at 10 is connected to a shaft 12 which may conveniently be a hollow steel or aluminum tube or alternatively may be of wood or plastic.

The retriever head 10 consists of a generally circular loop 14 of substantially rigid material such as metal or plastic. The loop has an inner diameter shown as D2. The loop 14 may be integrally connected to a subshaft 16 which may be connected to the shaft 12 in any convenient fashion. For example, in the case of a tubular metallic handle, the subshaft is connected by flattening the material of the metallic shaft about the subshaft thereby capturing a portion 18 within it.

A retaining finger 20 which may be integrally formed as a continuation of the subshaft 16 projects part way over the opening 22 of the loop 14.

A spiral 24, which is preferably made of spring steel or plastic, is wrapped loosely about the loop 14 in such a fashion that the loop 14 is located within the coils of the spiral 24. The spiral forms a complete substantially circular shape conforming to the substantially circular shape of the loop. The ends of the spiral 24 are connected together in such a fashion that circumferential tension is placed on the spiral 24. This causes the spiral to be drawn inward such that it bears against the outer largest diameter perimeter 26 of the loop 14. Since the spiral has a coil diameter which is substantially larger than the diameter of the material forming the loop 14, the inner portions 28 of the spiral project inward into the opening 22 and reduce the effective diameter of the opening 22 to a diameter shown as D1. Diameter D1 is substantially smaller than the diameter of the golf ball and the diameter D2 is substantially larger than the diameter of a golf ball.

Due to the dimensional relationships recited in the preceding, a golf ball may pass through the opening 22 with only slight resistance.

Figure 2:
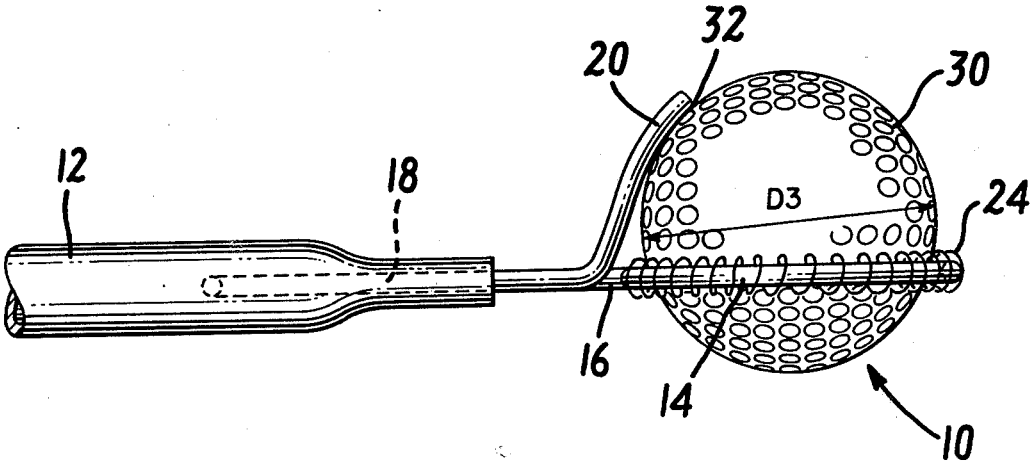
FIG. 2 shows a side elevation of a portion of the golf ball retriever with a golf ball captured therein.

Turning now to FIG. 2 there is shown a side view of the retriever with a golf ball 30 captured therein. The golf ball diameter D3 is larger than D1 and smaller than D2. Thus, after the golf ball is forced through the opening 22, the spring steel spiral 24 restores itself to support the ball in the position shown with the diameter D3 substantially above the loop 14. The retaining finger 20 bears upon the surface of the ball 30 at a point 32 thereby maintaining the ball 30 securely captured in the retriever head 10.

The retaining finger 20 touches the bearing point 32 well below the top of the golf ball 30. Also the golf ball 30 extends below the loop 14. Consequently, there is one dimension of the ball as captured in the retriever head 10 which is no greater than the dimension of the ball itself. This is useful in retrieving the ball through narrow openings such as the opening in a chain link fence.

Figure 3:
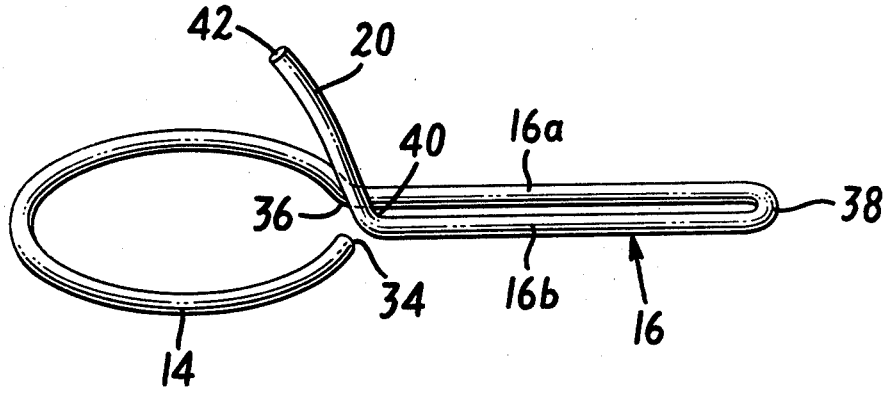
FIG. 3 shows a unitary assembly forming the loop, subshafts and retaining finger of the golf ball retriever.

Turning now to FIG. 3, there is shown a preferred method of forming the loop 14, subshaft 16 and retaining finger 20 from a single piece of ductile material such as steel wire. Beginning at a first end 34, the ductile material is formed into a unitary circular loop 14 and integrally connected at a bend 36 to a generally straight outgoing subshaft 16a which is integrally connected at a hairpin bend 38 to a generally straight incoming subshaft 16b which is generally parallel to outgoing subshaft 16a.

The incoming subshaft 16b is integrally connected at a bend 40 to the retaining finger 20. The retaining finger 20 ends at end 42. The retaining finger 20 extends in a direction generally upward and inward in a direction whose projection upon the plane of the loop 14 generally follows a diameter (not shown) of the loop. The retaining finger 20 may end as shown part way across the loop 14 or, alternatively, it may extend completely across the loop and the end 42 may be adjacent to the loop 14 at a position 180 degrees around the loop 14 from the end 34.

Alternatively the assembly shown in FIG. 3 may be formed from other than ductile metal. For example, the assembly shown in FIG. 3 may be integrally formed as a unit from plastic formed by injection molding or other means. In that case, the outgoing and incoming subshafts 16a, 16b may conveniently be fused into a single piece and the end 34 may be integrally joined to the subshafts 16a, 16b near the bend 40 to form a more rigid unit. In addition, the spiral 24 (FIGS. 1 and 2) may also be formed of suitable plastic without departing from the spirit of the present invention.

Figure 4:
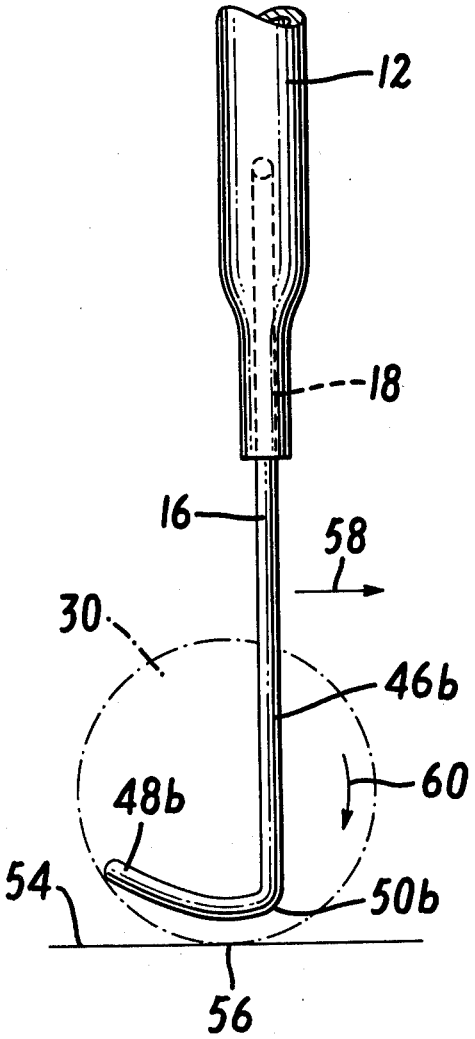
FIG. 4 shows a side view of another embodiment of the golf ball retriever.
Figure 5:
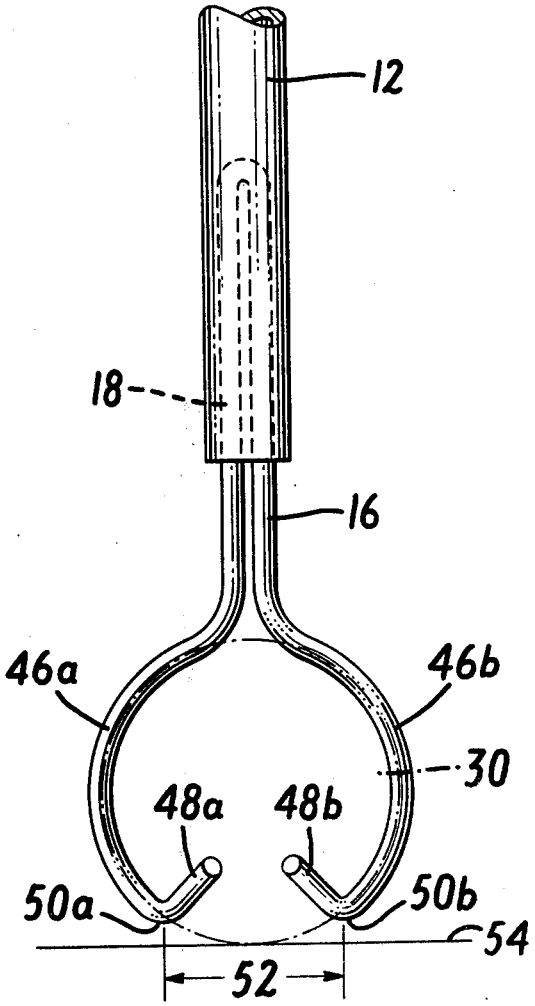
FIG. 5 shows a front view of the embodiment of FIG. 4.

Turning now to FIGS. 4 and 5 there is shown an embodiment of the invention employing two semi-circular loops 46a, 46b which substitute for the single loop 14 shown in FIGS. 1–3. The semi-circular loops 46a, 46b are attached to the subshafts 16. The subshafts 16 and/or the semi-circular loops 46a, 46b are made of resilient material to thus allow the entry of the ball 30 between them to deflect the semi-circular loops 46a, 46b outward slightly and to close on the ball 30 to capture it after the passage of its diameter therethrough.

The semi-circular loops 46a, 46b are connected to retaining fingers 48a, 48b at bends 50a, 50b. The retaining fingers 48a, 48b are shaped to contact the surface of a captured ball 30 and to retain it in the retriever.

A substantial gap 52 exists between the bends 50a, 50b, thus permitting the surface of the ball 30 to contact a generally plane surface 54, such as the ground or a floor, at a point 56 between them. This permits rolling the ball 30 into the captured position even with the shaft 12 and the plane of the semi-circular loops 46a 46b substantially vertical as will be explained.

The ball 30 may be captured by slipping the semi-circular loops 46a, 46b over the ball 30 in a direction generally normal to their plane. When a ball 30 is accessible only from directly above, for example, when it is in a sewer accessible through a grating or similar situation, it is not possible to press the retriever shown down over the ball 30. If the ball 30 cannot be maneuvered against a wall or other solid object in order to press it through the loop, the retrievers of FIGS. 1–3 have difficulty capturing it.

The embodiment of the retriever in FIGS. 4 and 5 can be used in the vertical position without the need for an object or a wall against which to press the ball 30. The semi-circular loops 46a, 46b are made to approach the ball 30 from the left, as shown in FIG. 4 and to move in the direction shown by the arrow 58. Since the ball 30 remains in contact with the surface 54 at point 56 between the bends 50a, 50b while the retriever is moved into contact with the ball 30, the ball 30 is caused to roll in the direction indicated by the arrow 60. The ball 30 thus tends to roll into position between the semi-circular loops 46a, 46b until stopped by the retaining fingers 48a, 48b. In this condition, the ball 30 has been captured.

It would be evident that one of the retaining fingers 48a, 48b could be eliminated without interfering with the function of the retriever. In addition, a spring spiral (not shown) may be placed on the semi-circular loops 46a, 46b the aid in capturing the ball.

It will be understood that the claims are intended to cover all changes and modifications of the preferred embodiments of the invention, herein chosen for the purpose of illustration which do not constitute departures from the spirit and scope of the invention.

What is claimed is:

1. A ball retriever for retrieving a ball comprising:

(a) an elongated shaft;

(b) a generally circular loop having an effective inner diameter smaller than the diameter of said ball;

(c) means for connecting said loop to said shaft;

(d) resilient means for permitting the enlargement of said inner diameter by the passage of said ball partly through said loop, said resilient means partially closing about said ball after the passage of the widest part thereof through said loop;

(e) the plane of said loop and the axis of said shaft being substantially parallel;

(f) at least one finger means for stopping and holding said ball after its diamater has passed through said loop but before the entire ball has passed through said loop; and (g) said at least one finger means extending at least part way across said loop.

2. The apparatus recited in claim 1 further comprising:

(a) said loop being a closed circle;

(b) said resilient means being a spring spiral encircling a substantial part of said closed circle;

(c) the diameter of said spiral being substantially greater than the material forming said loop; and (d) said spring spiral being biased into contact with the outer perimeter of said loop whereby the portion of the coils of said spiral are biased out of contact with said loop and project partly into the central opening of said loop.

3. The apparatus recited in claim 1 further comprising:

(a) said loop being first and second semi-circular loops facing each other and forming a generally circular opening;

(b) each of said first and second semi-circular loops being connected to said shaft at a first end thereof and extending symmetrically toward the second end thereof;

(c) a gap between the closest approach of the second ends of said first and second semi-circular loops; and (d) said gap being large enough to permit contact between the surface of a ball captured in said retriever and a generally plane surface normal to the plane of said loop at a point between said second ends.

4. Apparatus recited in claim 3 further comprising said finger means being attached to the second end of at least one of said semi-circular loops.

5. In a ball retriever of the type having a shaft and a retriever head attached to said shaft the improvement of a retriever head comprising:

(a) a circular loop having an inner diameter substantially greater than the diameter of said ball;

(b) a substantially rigid retaining finger extending from the perimeter of said loop out of the plane of said loop inclined toward the axis thereof and terminating before reaching the axis thereof;

(c) a spring spiral having a spiral diameter substantially greater than the diameter of material forming said loop;

(d) said spring spiral being threaded over said loop and covering a substantial portion thereof;

(e) said spring spiral being biased in tension in the tangential direction whereby the spiral is pulled into contact with the outer perimeter of said loop and the inner part of the spiral projects part way into the opening of said loop thereby reducing the open dimensions thereof;

(f) the open dimensions of said loop including said spiral projecting part way thereinto being substantially smaller than the diameter of said ball;

(g) said spiral permitting the enlargement of the inner diameter by the passage of said ball partly through said loop and partially closing about said ball after the passage of the widest part thereof through said loop; and (h) said finger being effective to stop and hold said ball after its diameter has passed through said loop but before the entire ball has passed through said loop.

6. In a ball retriever of the type having a shaft and a retriever head attached thereto, the improvement of a retriever head comprising:

(a) first and second semi-circular loops attached at one of their ends to said shaft and extending symmetrically in a plane parallel to the axis of said shaft and having second ends separated by a gap;

(b) said first and second semi-circular loops describing a substantial part of a circle having a diameter smaller than the diameter of said ball;

(c) resilient means for permitting said first and second semi-circular loops to separate sufficiently to permit the passage therebetween of the diameter of said ball;

(d) at least one retaining finger extending out of the plane of said circule and generally toward the axis thereof;

(e) said at least one retaining finger ending short of the axis of said circle;

(f) said at least one retaining finger being effective to contact the surface of said ball and stop said ball after its diameter has passed between said first and second semi-circular loops and to hold said ball captured between itself and said first and second semicircular loops; and (g) said gap permitting contact therebetween of the surface of a ball captured in said retriever head and a generally plane surface disposed normal to the plane of said circle.

7. The apparatus recited in claim 6 further comprising said retriever with a ball captured therein having at least one cross section normal to the axis of said shaft which is no greater than the diameter of said ball, whereby a ball may be drawn through an opening which has one dimension no larger than said ball.

* * * * *